US006597316B2

(12) United States Patent
Rao et al.

(10) Patent No.: US 6,597,316 B2
(45) Date of Patent: Jul. 22, 2003

(54) SPATIAL NULL STEERING MICROSTRIP ANTENNA ARRAY

(75) Inventors: Barsur Rama Rao, Lexington, MA (US); Edward N. Rosario, Methuen, MA (US)

(73) Assignee: The Mitre Corporation, Bedford, MA (US)

( * ) Notice: Subject to any disclaimer, the term of this patent is extended or adjusted under 35 U.S.C. 154(b) by 0 days.

(21) Appl. No.: 09/954,527

(22) Filed: Sep. 17, 2001

(65) Prior Publication Data

US 2003/0052825 A1 Mar. 20, 2003

(51) Int. Cl.[7] ..... H01Q 1/38
(52) U.S. Cl. ..... 343/700 MS; 343/846
(58) Field of Search ..... 343/700 MS, 853, 343/850, 846, 848; H01Q 1/38

(56) References Cited

U.S. PATENT DOCUMENTS

| | | | | |
|---|---|---|---|---|
| H375 H | | 11/1987 | Dinger | 342/372 |
| 4,821,040 A | | 4/1989 | Johnson et al. | 343/700 |
| 4,827,271 A | | 5/1989 | Berneking et al. | 343/700 |
| 5,003,318 A | | 3/1991 | Berneking et al. | 343/700 |
| 5,043,738 A | | 8/1991 | Shapiro et al. | 343/700 |
| 5,548,297 A | * | 8/1996 | Arai | 343/700 MS |
| 5,565,875 A | * | 10/1996 | Buralli et al. | 343/700 MS |
| 5,872,540 A | | 2/1999 | Casabona et al. | 342/362 |
| 5,940,037 A | | 8/1999 | Kellerman et al. | 343/700 |
| 5,952,971 A | * | 9/1999 | Strickland | 343/700 MS |
| 6,084,548 A | | 7/2000 | Hirabe | 343/700 |
| 6,133,879 A | | 10/2000 | Grangeat et al. | 343/700 |
| 6,166,692 A | | 12/2000 | Nalbandian et al. | 343/700 |
| 6,166,702 A | | 12/2000 | Audenaerde et al. | 343/795 |
| 6,300,908 B1 | * | 10/2001 | Jecko et al. | 343/700 MS |

* cited by examiner

*Primary Examiner*—Hoanganh Le
(74) *Attorney, Agent, or Firm*—Choate, Hall & Stewart

(57) ABSTRACT

A spatial null steering microstrip antenna array comprising two concentric microstrip patch antenna elements. An inner circular antenna is used as an auxiliary element in nulling interference received by an outer annular ring antenna disposed around the inner antenna. The outer annular antenna is resonant in a higher order mode but forced to generate a right hand circularly polarized lower order ($TM_{11}$) far field radiation pattern, thereby allowing co-modal phase tracking between the two antenna elements for adaptive cancellation. Each antenna element is appropriately excited by symmetrically spaced probes. Other applications of the antenna array include GPS multipath suppression, simultaneous satellite and terrestrial communications, and co-site interference suppression. Dual frequency band applications are achieved by stacked array configurations.

10 Claims, 5 Drawing Sheets

( 12b, 12d, 14b 14d Not Shown)

( 26b, 26d, 28b 28d, 30b, 30d, 32b, 32d, Not Shown)

FIG.5a Far-field amplitude of Cy1195a4.nsi
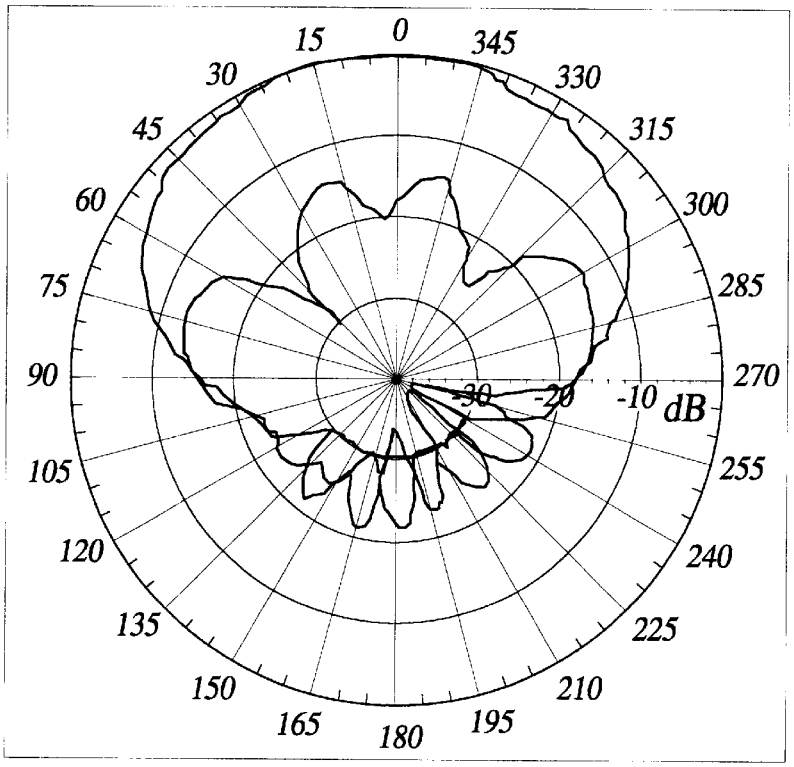
FIG.5b Far-field amplitude of Cy1200a1.nsi
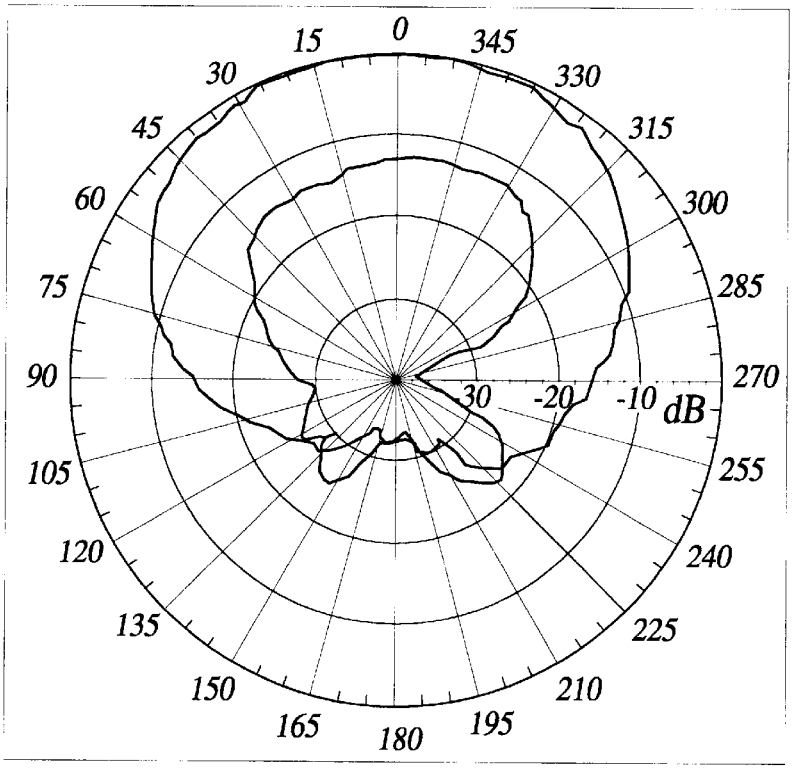

SPATIAL NULL STEERING MICROSTRIP ANTENNA ARRAY

The invention described herein may be manufactured and used by or for the Government for governmental purposes without the payment of any royalty thereon.

FIELDS OF THE INVENTION

The present invention relates generally to radio-frequency antenna structures. More specifically, the present invention relates to microstrip antenna arrays for use in navigation systems, such as the Global Positioning System (GPS), and in wireless and satellite communications systems. The present invention further relates to generating spatial nulls with pairs of microstrip antenna elements excited in fundamental and higher order modes. The present invention also relates to multiple frequency band applications in the aforementioned fields.

BACKGROUND OF THE INVENTION

Any communications or navigation system is susceptible to degradation due to interfering conditions. The carrier signal is vulnerable to interruption by natural phenomena, interference from other signals or countermeasures. Countermeasures may take the form of a variety of jamming schemes whose sole purpose is to disrupt the operation of a receiver.

A variety of techniques are currently used to decrease the effects of interference in receivers. Adaptive nulling involves the cancellation of a signal received by one antenna element relative to another. A conventional, multi-element adaptive array requires "N" number of elements to null out "N−1" interference sources. For example, a seven-element array can, at the most, suppress six broadband interference sources. Since each antenna element needs its own receiver and also a complex weighting network to adapt the antenna pattern, the high cost and technical complexity of such a multi-element antenna array may make it unattractive for many commercial and military systems in which cost and simplicity are important considerations. Thus, a need exists for a simple adaptive array as an alternative to more complex and expensive multi-element adaptive arrays.

Due to limited space availability in airborne platforms, antennas used by various avionics systems are placed very close together resulting in significant co-site interference from harmonics of the signals radiated by the neighboring antennas, or from "splatter" of the transmitted energy outside their specified frequency band. A low profile means for suppressing co-site interference in antennas used for satellite navigation and communications without affecting the ability of the antenna array to receive desired signals would clearly be beneficial.

Multipath is a significant problem in both navigational and communications systems. It degrades navigational accuracy in GPS systems and can be a source of interference in communications systems. Multipath can be caused by "structural" reflections (such as shown in FIGS. 1*a* and 1*b*) from specular reflecting surfaces of numerous scattering sources common to an urban environment such as buildings, large vehicles, aircraft or ships. Alternatively, multipath can be caused by ground reflections at low grazing angles off the moist ground, rooftops, sea surface or a large body of water close to the antenna. Since the GPS satellites transmit right-handed circularly polarized (RHCP) signals, and the polarization of the multipath signal after reflection is normally reversed, the rejection of the cross-polarized (left-handed circularly polarized, LHCP) signals is important to avoid multipath problems.

Various types of antennas have been proposed for GPS multipath mitigation. Choke ring ground planes are circular ground planes with quarter wavelength slots to present a high impedance to currents flowing on the ground plane to prevent their interference with the antenna radiation. A typical choke ring ground plane has a diameter of about 14 to 16 inches, a height of about 3 inches or higher, and a weight of approximately 10 to 20 pounds. Such antennas are not suitable for airborne applications because of their construction and weight. Additionally, it is difficult to design choke ring ground plane antennas that operate simultaneously in the two GPS frequency bands ($L_1$ and $L_2$). Other types of GPS multipath limiting antennas also exist, but have even larger physical sizes or profiles.

Microstrip patch antennas are attractive due to their compact structure, light weight due to the absence of heavy metal stamped or machined parts, and low manufacturing cost using printed circuit technology. They also provide low profiles, conformity to surfaces and direct integration with microwave circuitry. Consequently, microstrip patch antennas are used widely in antenna arrays.

Nurie and Langley have studied the use of concentric annular patches with circumferential slots as a dual frequency band microstrip antenna array. *Performance of Concentric Annular Patches as a Dual Frequency Band Microstrip Array Element*, Sixth International Conference on Antennas and Propagation, 1989. They experimented with exciting the annular ring patches in two different modes, a lower order $TM_{11}$ mode and a higher order $TM_{12}$ mode. However, they encountered difficulties in exciting the $TM_{12}$ mode due to the presence of other even higher order modes that were either close to or overlapping the frequency band of interest. They have attempted to suppress these higher order modes by cutting slots in the outer annular ring. They also operated the two antennas as separate entities to service two completely different communications or radar systems, but no attempt was made to adaptively combine the signals from these two antennas so as to generate a combined antenna pattern with a spatial null for mitigation of interference or to suppresses the cross polarized radiated signals to suppress multipath.

U.S. Pat. No. 5,099,249 to Seavey discloses two element antenna arrays, including at least one annular ring antenna excited in a higher order mode, exclusively for providing simultaneous satellite and terrestrial communications. However, the disclosed arrays again do not attempt to adaptively combine the signals from the at least one annular ring antenna and other antennas in the disclosed arrays to generate nulls for reducing multiple interference signals, co-site interference signals, or GPS multipath. In addition the radiation mode that was used for terrestrial communication was a higher order mode with a radiation pattern that has multiple lobes that is not optimum for terrestrial communications in all azimuthal directions.

SUMMARY OF THE INVENTION

Accordingly, it is an objective of the invention to address the needs described above by providing an antenna array capable of steering a wide spatial null for limiting multiple interference sources, such as natural multipath or electronic countermeasures at a desired elevation angle, preferably on or close to the horizon.

It is a further objective of the present invention to provide a lightweight, low cost alternative to more complex and expensive multi-element adaptive arrays by the use of microstrip patch elements. Advantages offered by this antenna array include its low profile making it attractive for airborne systems because of reduced aerodynamic drag, its low manufacturing cost using printed circuit technology, and its light weight due to the absence of heavy metal stamped or machined parts in its construction.

It is a further objective of the present invention to provide a low-profile means for suppressing co-site interference in antennas used for satellite navigation and communications without affecting the ability of the antenna array to receive desirable signals.

And it is yet another objective of the present invention to provide an antenna array capable of simultaneous satellite and terrestrial communication in a plurality of frequency bands, by generating two different, orthogonal types of antenna patterns—one directed towards zenith for communicating with satellites, and the other towards horizon to facilitate terrestrial communications.

In one embodiment, the present invention is a two element microstrip antenna array designed to place a deep spatial "ring" null in the radiated antenna pattern over a 360° azimuth circle at either the horizon, the most prevalent interference scenario, or another selected low elevation angle. The antenna array comprises an inner microstrip patch antenna for use as an auxiliary element in nulling interference, and an outer microstrip patch antenna disposed around the inner microstrip patch antenna, the outer microstrip patch antenna having a geometry symmetrical to the inner microstrip patch antenna and resonance in a higher-order, such as the $TM_{41}$ mode. A dielectric substrate layer separates the patch antennas and a conducting ground plane that extends beyond the outermost dimensions of the outer microstrip patch antenna. Both the inner patch antenna and outer patch antenna are each connected to sets of four coaxial probes that extend up through the conducting ground plane and dielectric substrate layer and are symmetrically spaced at 90° intervals around the respective patch antennas. Each probe of each set of four coaxial probes are driven in equal amplitudes but at relative phase angles of 0°, 90°, 180°, and 270° respectively, thereby forcing both the outer microstrip patch antenna and inner microstrip patch antenna to generate a right hand circularly polarized lower order $TM_{11}$ mode far field radiation pattern and allowing co-modal phase tracking between the inner microstrip patch antenna and outer microstrip patch antennas. The arrangement of the four probes of the inner microstrip patch antenna relative to the location of the four probes in the outer microstrip patch antenna are not critical as long as the proper relative phase relationship is maintained among the four probes comprising each set. Another advantage of using a symmetric set of four probes that are properly phased is the suppression of higher order modes from being excited in the larger outer microstrip patch antenna.

To generate a spatial ring null at a desired elevation angle, such as the horizon, signals received by the inner microstrip antenna and outer patch antenna are combined through an adaptive nulling network consisting of a variable attenuator and a variable phase shifter. The signal from the inner circular patch antenna, which has a higher gain, is first attenuated such that its signal is equal in amplitude to the signal received by the outer annular ring in the specific direction in which the null is to be placed; next, the phase shifter is varied until the phase angles of the signals from these two antennas are exactly 180° (or opposite) in phase so as to cancel each other out to form a null in the desired direction of the null. The antenna pattern "shaped" in this manner generates a spatial "ring null" around a complete 360° circle in azimuth enabling the antenna to simultaneously null out multiple interference sources that impinge on the antenna array.

In a preferred embodiment, the inner microstrip patch antenna comprises a circular microstrip patch antenna for use as the auxiliary element in nulling interference, and the outer microstrip patch antenna comprises an annular ring microstrip patch antenna disposed around the circular microstrip patch antenna. The conducting ground plane is comprised of either a simple metal plate or preferably a kapton film with a sputtered, tapered resistive film of Indium Tin Oxide, bonded to a thin plastic plate. The conducting ground plate has the effect of suppressing antenna backlobes.

In another embodiment, the present invention is a GPS multipath suppression antenna array, comprising an annular ring antenna for receiving GPS signals resonant in a higher order $TM_{41}$ mode, a circular microstrip antenna concentrically positioned within the annular ring antenna for use as an auxiliary element in cancelling out cross polarized LHCP multipath signals received by the annular ring antenna, a dielectric substrate layer sandwiched below the antennas and above a resistivity tapered ground plane, and a means for exciting both the circular microstrip antenna and the annular ring antenna to generate RHCP lower order $TM_{11}$ mode far field radiation patterns, allowing the annular ring radiation pattern to phase track the radiated signals from the circular microstrip antenna to allow cancellation of the cross polarized GPS multipath at a desired elevation angle.

In another embodiment, the present invention is a dual frequency GPS multipath suppression antenna array, comprising a first annular ring antenna for receiving GPS signals in a first frequency band resonant in a higher order $TM_{41}$ mode, a first circular microstrip antenna concentrically positioned within the first annular ring antenna for use as an auxiliary element in cancelling out cross polarized LHCP multipath signals received by the first annular ring antenna, a first dielectric substrate layer sandwiched beneath the first antennas and above a resistivity tapered ground plane, a second dielectric substrate layer stacked on top of the first circular and first annular ring antennas, a second annular ring antenna for receiving GPS signals in a second frequency band resonant in a higher order $TM_{11}$ mode stacked on top of the second dielectric substrate layer and positioned coaxially above the first annular ring antenna, a second circular microstrip antenna positioned within the second annular ring antenna and stacked on top of the second dielectric substrate layer and positioned coaxially above the first circular microstrip antenna, means for exciting both the first circular microstrip antenna and the first annular ring antenna to generate RHCP lower order $TM_{11}$ mode far field radiation patterns, allowing the first annular ring radiation pattern to phase track the radiated signals from the first circular microstrip antenna to allow cancellation of the cross polarized GPS multipath at a desired elevation, and means for exciting both the second circular microstrip antenna and the second annular ring antenna to generate RHCP lower order $TM_{11}$ mode far field radiation patterns, allowing the second annular ring radiation pattern to phase track the radiated signals from the second circular microstrip antenna to allow cancellation of the cross polarized GPS multipath at a desired elevation angle.

In another embodiment, the present invention is a dual use satellite and terrestrial communications antenna array, comprising a circular microstrip patch antenna generating a single lobe, circularly polarized antenna pattern directed towards zenith for communicating with the satellite at a desired SATCOM frequency, and an annular ring microstrip patch antenna disposed around the circular microstrip patch antenna resonant in a higher order $TM_{41}$ mode, but generating a "zero" order (TEM type) doughnut-shaped modal antenna pattern with perfect symmetry in all 360 degrees in azimuth and with peak gain at the horizon. Such an antenna pattern allows good terrestrial communications with mutiple users located at or near the horizon but spread uniformly all around the antenna. This antenna also has a null at zenith to minimize interference with the satellites appearing at higher elevation angles closer to the zenith direction. The excitation of this "zero" order mode in the annular ring antenna is achieved by maintaining all four probes at the same zero relative phase and equal amplitude. This type of symmetric pattern provides this antenna with a distinct advantage over other higher order mode patterns which do not have such symmetry in azimuth that are generated in antennas built by other workers, such as in U.S. Pat. No. 5,099,249 described earlier. A dielectric substrate layer is sandwiched beneath the circular microstrip patch antenna and annular ring microstrip patch antenna and above a conducting ground plane, and a plurality of coaxial probes, each probe extending through the conducting ground plane and dielectric substrate layer, for exciting the circular microstrip patch antenna or the annular ring microstrip patch antenna. Additionally, the circular microstrip patch antenna and annular ring microstrip patch antenna may each be tuned to separate frequencies to allow simultaneous communications with a SATCOM and a terrestrial communications system operating at different frequency bands. The two antennas in the array can also be tuned to the same frequency band so as to maintain continuous communications with a SATCOM system containing multiple satellites located at different elevation angles but all operating in the same frequency band.

BRIEF DESCRIPTION OF THE DRAWINGS

FIG. 5*a* is a chart illustrating the measured pattern at horizon of an annular ring of a prototype two element array on a metal ground plane prior to cross polarization nulling.

FIG. 5*b* is a chart illustrating the measured pattern at horizon of an annular ring of a prototype two element array on a tapered resistivity ground plane during cross polarization nulling.

DETAILED DESCRIPTION

Preferred embodiments of the invention will now be described with reference to the accompanying drawings.

Figure 2:
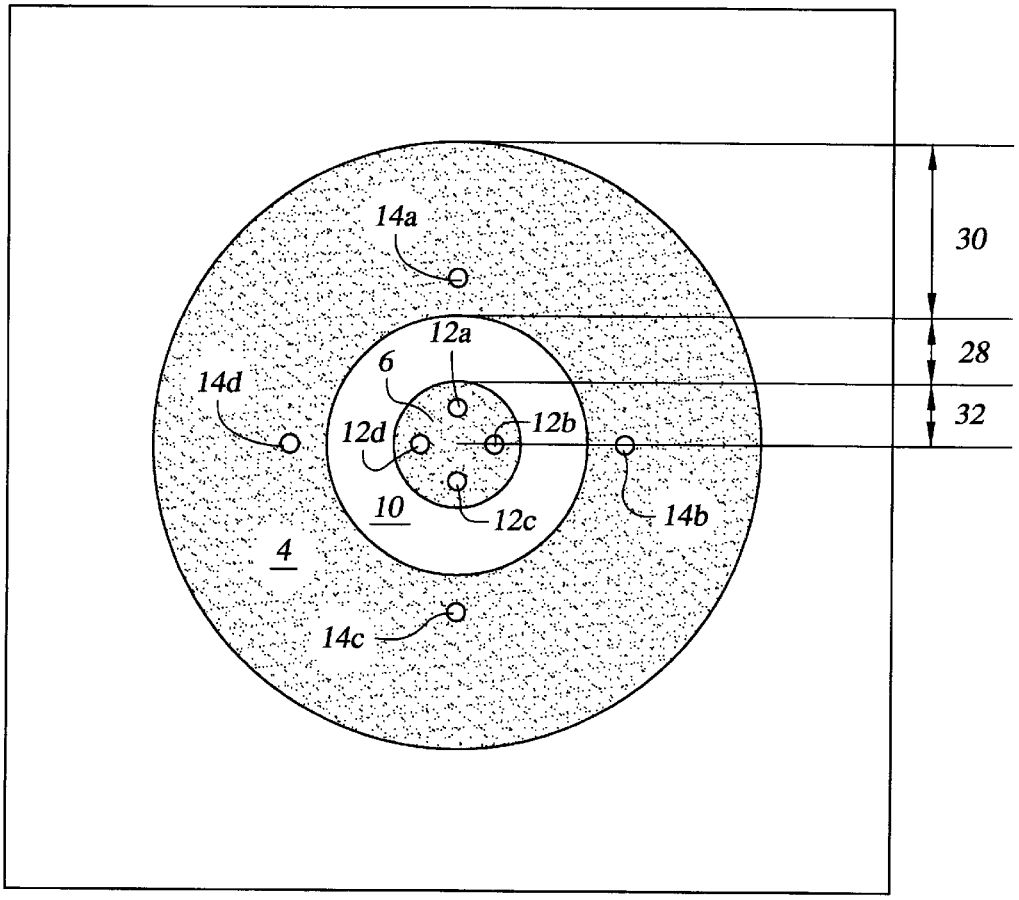
FIG. 2 is a schematic diagram illustrating a top view of a two-element antenna array in accordance with the invention.
Figure 4:
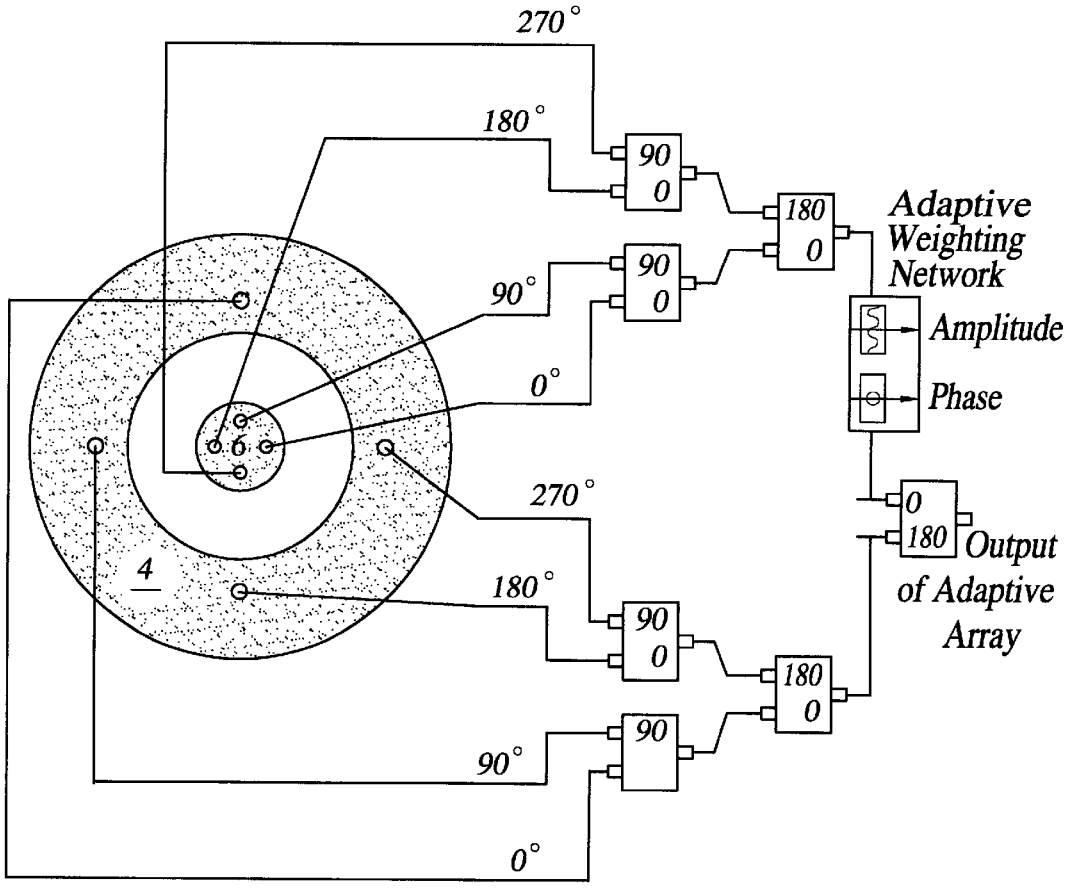
FIG. 4 is a schematic diagram of an adaptive antenna array system with excitation probe phase angles specified and an adaptive nulling network that connects the signals from the two antennas to generate a spatial ring null in a combined pattern.

FIG. 2 illustrates an antenna array 2 for steering a spatial null according to the invention. Antenna array 2 is partially comprised of two concentric microstrip patch antennas. In a preferred embodiment, an outer annular ring microstrip "patch" antenna 4 (hereinafter "the annular ring antenna") is disposed about a centrally located inner circular microstrip "patch" antenna 6 (hereinafter "the inner patch antenna"). Both the annular ring antenna 4 and the inner patch antenna 6 are right hand circularly polarized. The annular ring antenna 4 is used as the "reference" element for receiving signals from GPS satellites, whereas the inner patch antenna 6 is used as an "auxiliary" element for nulling interference received by the annular ring antenna 4 in an adaptive array system 16 (such as shown in FIG. 4).

Figure 3A:
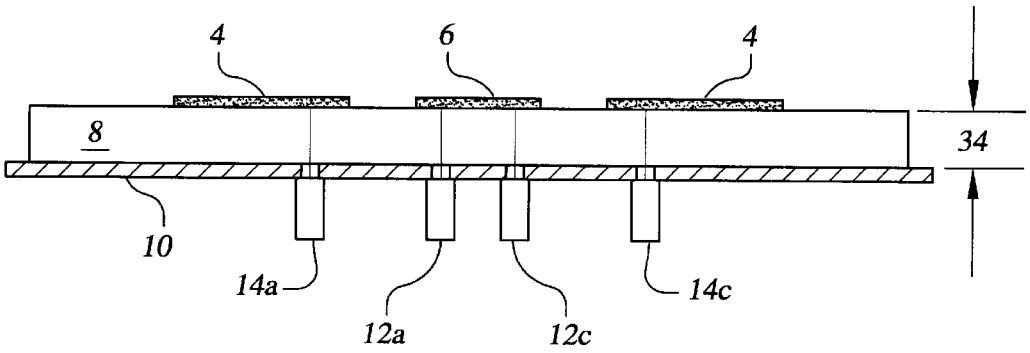
FIG. 3*a* is a schematic diagram illustrating a side view of a two-element antenna array in accordance with the invention.

As depicted in FIG. 3*a*, directly beneath the annular ring antenna 4 and inner patch antenna 6 is a dielectric substrate layer 8 that separates the annular ring antenna 4 and inner patch antenna 6 from a conducting ground plane 10. The conducting ground plane 10 is either metallic or a resistivity-tapered surface and assists in the suppression of antenna pattern back-lobes. The conducting ground plane 10 encompasses a surface area greater than the footprint of the annular ring antenna 4 and inner patch antenna 6. In a working prototype the inventors have built and tested, the conducting ground plane 10 was designed to be lightweight by using a kapton film with a sputtered, tapered resistive film of Indium Tin Oxide, bonded to a thin plastic plate. Since it does not need quarter wavelength deep choke rings, the conducting ground plane 10 also has a very low profile. In the prototype, both microstrip antennas were machined on a 0.1-inch thick Rogers 6010LM dielectric substrate. This substrate has a dielectric constant of 10.2 and a loss tangent of 0.0028.

The frequency response, radiation patterns and polarization characteristics of the antenna array 2 can be "tailored" by selecting appropriate design parameters for the annular ring antenna 4 and the inner microstrip patch antenna 6. The design parameters which must be appropriately selected include the cross-sectional diameter 28 and width 30 of the annular ring antenna 4, the cross-sectional diameter 32 of the inner microstrip patch antenna 6, the thickness 34 and dielectric constant of the dielectric substrate layer 8 supporting the inner microstrip patch antenna 6 and annular ring antenna 4, the selection of the feed positions for the first set of coaxial probes 12*a–d* and second set of coaxial probes 14*a–d*, and the excitation amplitudes and phase angles desired to achieve particular patterns or polarizations. (Only two probes or each set of four probes are illustrated in the side view provided in FIG. 3*b*.) This flexibility in design allows the antenna array 2 to be used in numerous applications in addition to spatial null steering.

Because the annular ring antenna 4 has to have a radius 28 that is larger than the radius 32 of the inner patch antenna 6, it was designed to be resonant in the $TM_{41}$ higher order mode (other higher order modes could have been used), but to have the capacity through appropriate excitation and phasing to generate a radiation pattern similar to that of a lower order $TM_{11}$ mode to offer the best reception of GPS satellite signals. The inner and outer diameters of the annular ring antenna 4 prototype model were 1.01" and 2.250", respectively. The antenna array 2 has a very low profile (no greater than 0.6 inches) and is conformal, making it attractive for airborne applications where low aerodynamic drag is an important design requirement. The inner microstrip patch antenna 6 is resonant in the fundamental $TM_{11}$ mode, and in the prototype has a radius 32 of 0.680". The gain of the inner microstrip patch antenna 6 is nearly 7 dB greater than that of the annular ring antenna 4.

Feeding the inner patch antenna 6 and annular ring antenna 4 are two sets of four coaxial coaxial probes; the first set of four probes 12*a–d* feed the inner patch 6 and the second set of four coaxial probes 14*a–d* feed the outer annular ring 4. The first set of coaxial probes 12*a–d* extends up through the conducting ground plane 10 and dielectric substrate layer 8. As shown in FIG. 4, each of the coaxial probes 12*a–d* are connected on one end to one of four points symmetrically spaced at 90° intervals around the inner patch antenna 6. The second set of coaxial probes 14*a–d* also extends up through the conducting ground plane 10 and dielectric substrate layer 8. Each of the coaxial probes 14*a–d* are connected on one end to one of four points symmetrically spaced at 90° intervals around the annular ring antenna 4. The coaxial probes 14*a–d* are preferably located close to the inner radius 28 of the annular ring antenna 4 to obtain acceptable return loss (−10 dB across the 20 MHz $L_1$ band). This location yields an input impedance close to 50 omhs at resonance.

By selecting the proper excitation coefficients for the coaxial probes 12*a–d* and 14*a–d*, the antenna array 2 may be designed to have "co-phasal" current distribution and phase matching of the inner patch antenna 6 and annular ring antenna 4 as a function of azimuth angle. This then allows an antenna operator to use the antenna array 2 as an adaptive array to suppress interference or jamming from multiple sources at a specified elevation angle, such as the horizon from where most interference can be expected. Adaptive nulling involves the cancellation of a signal received by one antenna element relative to another. In the preferred embodiment, each of the first set of coaxial probes 12*a–d* and the second set of coaxial probes 14*a–d* are driven in equal amplitudes but at relative phase angles of 0°, 90°, 180°, and 270°, respectively. This forces the annular ring antenna 4 and inner microstrip patch antenna 6 to generate right hand circularly polarized lower order $TM_{11}$ mode far field radiation patterns, with a peak at zenith, similar to that of the dominant $TM_{11}$ mode.

Spatial Ring Nulling

To generate a spatial ring null at a desired elevation angle such as the horizon, the signals from the inner patch antenna 6 and outer patch antenna 4 are combined through an adaptive nulling network consisting of a variable attenuator and a variable phase shifter. The signal from the inner circular patch antenna 6, which has a higher gain, is first attenuated such that its signal is equal in amplitude to the signal received by the outer annular ring 4 in the specific direction in which the null is to be placed; next, the phase shifter is varied until the phase angles of the signals from these two antennas are exactly 180° (or opposite) in phase so as to cancel each other out to form a null in the desired direction of the null. The antenna pattern "shaped" in this manner generates a spatial "ring null" around a complete 360° in azimuth enabling the antenna to simultaneously null out multiple interference sources that impinge on the antenna array. An advantage of the present invention is that such a ring nulling antenna array simultaneously eliminates multiple interference sources while offering a significant reduction in complexity and cost over more complex multiple element adaptive antenna arrays.

In an alternative embodiment, the present invention is a spatial null steering antenna array partially comprised of a concentric inner microstrip patch antenna 6 and an outer microstrip patch antenna 4 functioning as auxiliary and reference elements in an adaptive array system as described above. Although the inner microstrip patch antenna and outer microstrip patch antenna are not necessarily circularly and annularly shaped, respectively, a geometric symmetry between the two antennas is important to enhanced performance. In this embodiment, the outer microstrip patch antenna similarly resonates in a higher order $TM_{41}$ mode, but is forced to generate a lower order $TM_{11}$ mode far field pattern with the inner microstrip patch antenna. Elliptical, rectangular and square geometries are considered within the scope of the present invention.

Co-Site Interference

An antenna array 2 according to the present invention can also suppress co-site interference from avionics antennas sharing an airborne platform with the antenna array 2. By shaping the antenna pattern to have minimum signal reception along the longitudinal axis of the aircraft where the neighboring antennas are located, co-site interference is suppressed. This adaptive nulling will not affect the ability of the antenna array 2 to receive signals from satellites at higher elevation angles.

Multipath Suppression

Figure 1A:
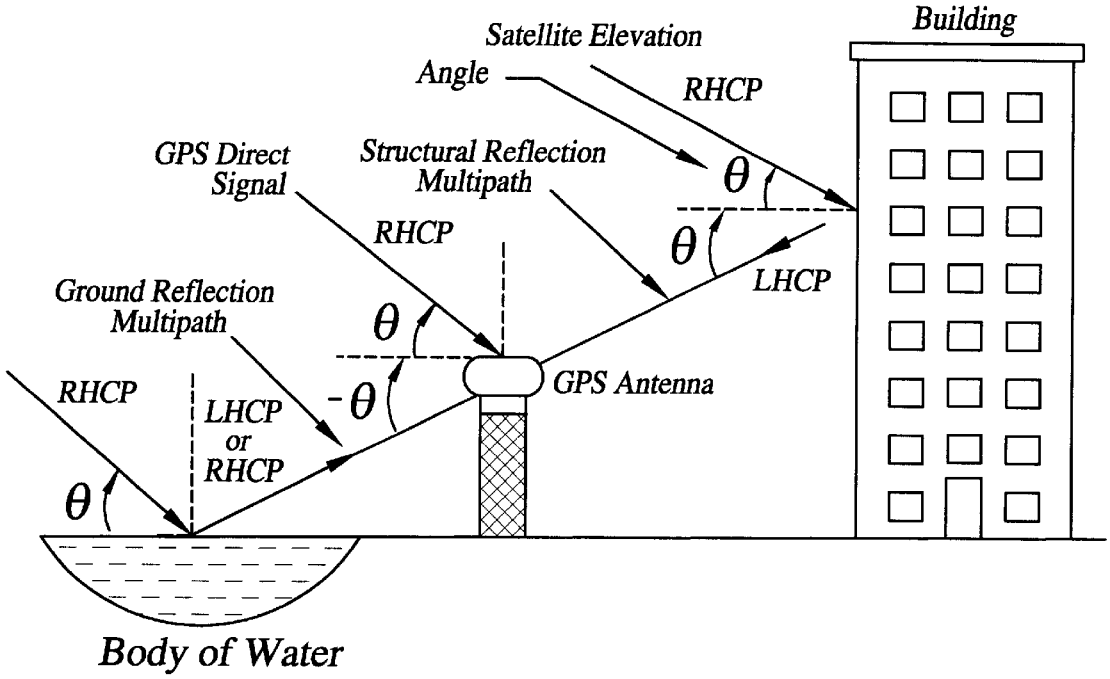
FIG. 1*a* is an illustration of structural and ground reflection multipath sources on a GPS antenna.
Figure 1B:
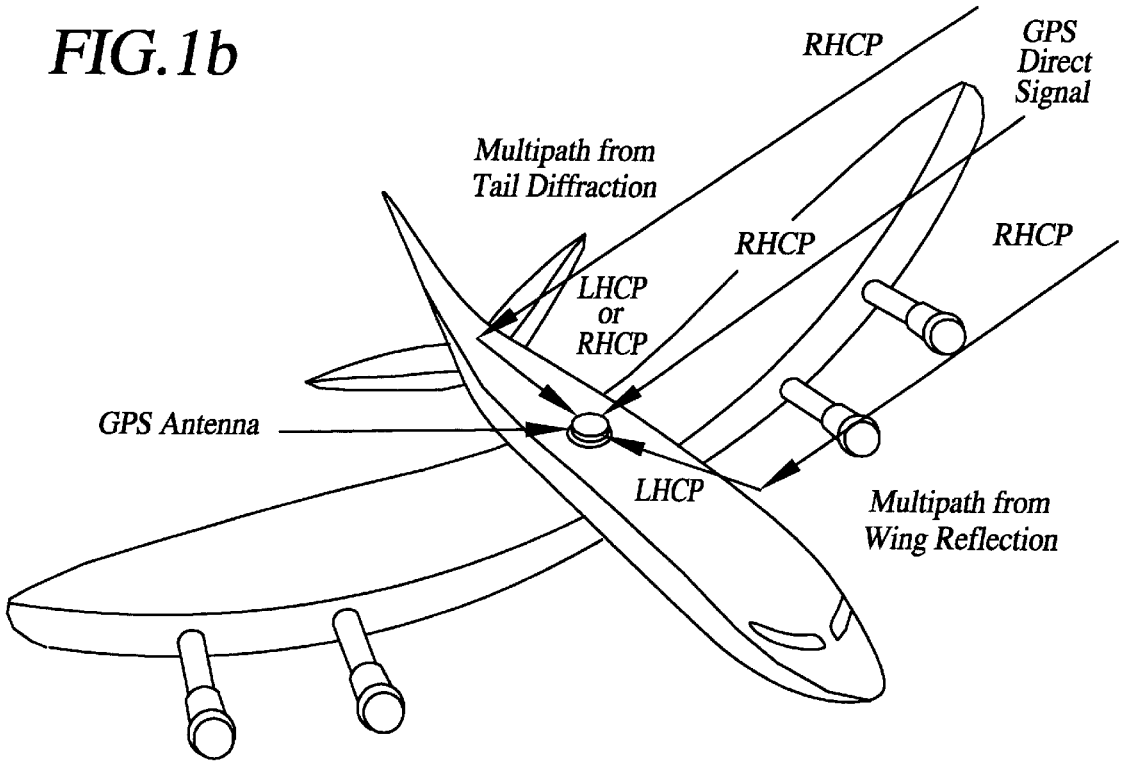
FIG. 1*b* is an illustration of multipath sources in a GPS antenna in an airborne system.

As previously described, GPS carrier multipath is a significant source of error that limits positioning accuracy of a Differential GPS. Structurally reflected multipath (as shown in FIGS. 1*a* and 1*b*) is typically incident on the antenna array 2 at an elevation angle above the horizon. Reflected multipath signals "reverse" their polarization upon reflection from a conducting surface. For example, a RHCP signal transmitted from a GPS satellite, upon suffering such a multipath reflection, would be incident on the antenna array 2 as LHCP signal. An antenna array 2 according to the present invention may effectively be used as an adaptive cross-polarization filter to cancel LHCP multipath over a complete 360° in azimuth. The cross-polarized LHCP gain of the inner microstrip patch antenna 6 at the horizon is nearly 4.5 dB higher than the gain of the annular ring antenna 4. The antenna array 2 of this embodiment is comprised of elements identical to those of the previous embodiments. The excitation and adaptive cancellation method of this embodiment is also similar to the ring nulling method described above, except that the polarization selected for nulling is the cross-polarized multipath signal.

Figure 6A:
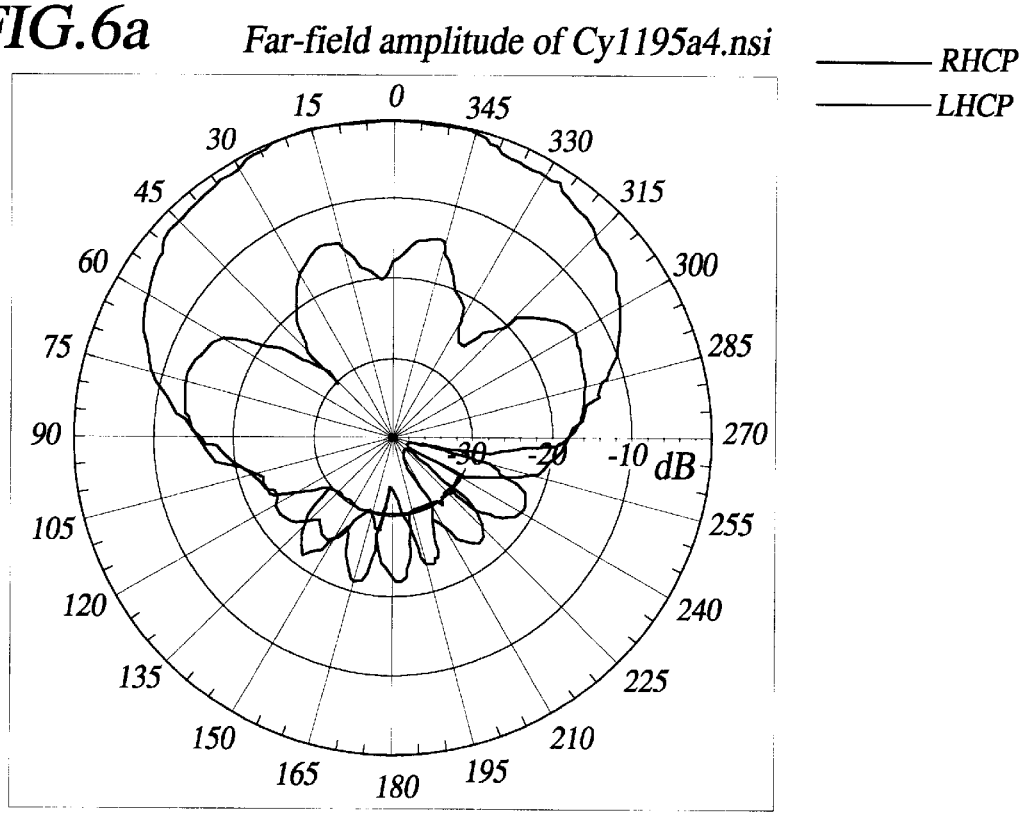
FIG. 6*a* is a chart illustrating the measured pattern at −30° elevation of an annular ring of a prototype two element array on a metal ground plane prior to cross polarization nulling.
Figure 6B:
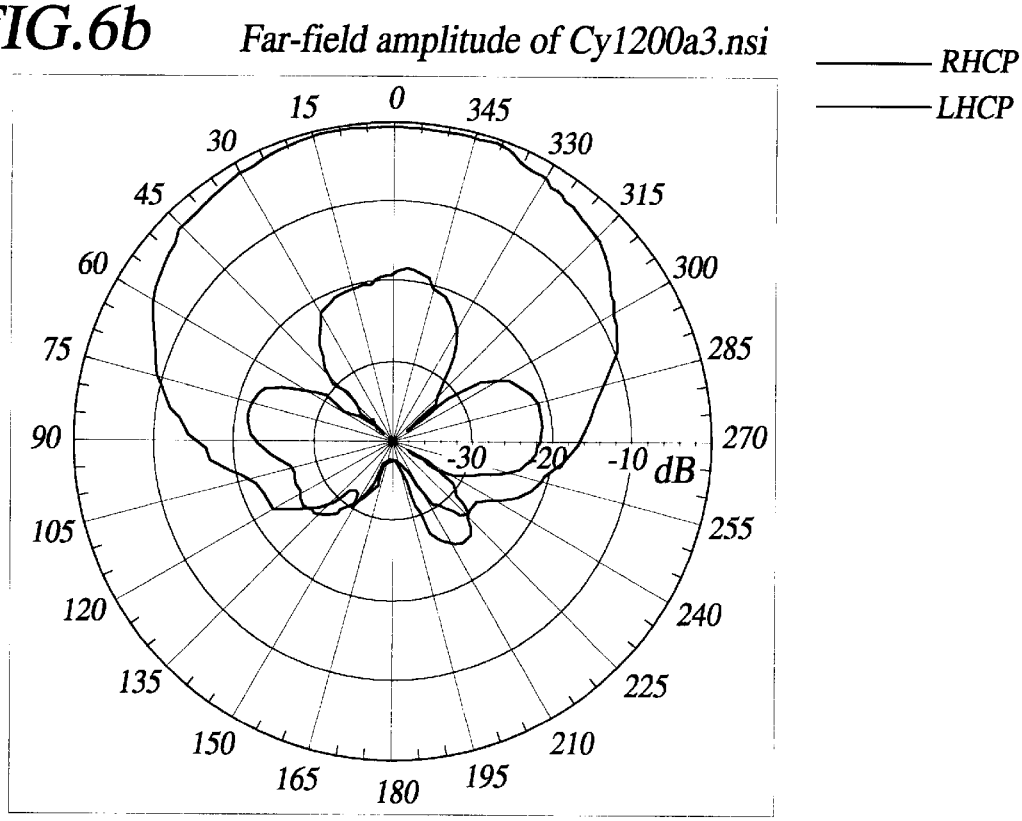
FIG. 6*b* is a chart illustrating the measured pattern at −30° elevation of an annular ring of a prototype two element array on a tapered resistivity ground plane during cross polarization nulling.

The inventors have found the GPS $L_1$ band antenna array 2 prototype described above to be effective in suppressing multipath through adaptive cross polarization nulling. FIG. 5*a* illustrates the measured pattern at horizon of the annular ring antenna 4 on a metal conducting ground plane 10 before cross polarization nulling, while FIG. 5*b* illustrates the measured pattern of the annular ring antenna 4 on a tapered-resistivity ground plane 10 after cross polarization nulling. FIG. 6*a* illustrates the measured pattern at −30° elevation of the annular ring antenna 4 on a metal conducting ground plane 10 before cross polarization nulling, while FIG. 6*b* illustrates the measured pattern of the annular ring antenna 4 on a tapered-resistivity ground plane 10 after cross polarization nulling. A significant reduction in the LHCP component may be seen over the entire upper hemisphere and even down to elevation angles below the horizon as low as −15°. There is negligible impact on the RHCP gain of the annular ring antenna 4 necessary for reception of GPS signals. An examination of FIG. 6*b* also reveals that the null in the cross-polarized pattern at the horizon results in an increased cross-polarized side lobe at a lower elevation angle below the horizon. This distortion in side lobe level can be minimized by taking an average value of the weights over a range of azimuth angles at the horizon rather than a specific azimuth angle of 275°. The degree of reduction in LHCP level varies from a maximum of 20 dB for the selected azimuth angle of 275°, where the specific amplitude and phase weights for polarization cancellation were estimated, to a minimum of approximately 5 dB at an azimuth of 180° due to pattern distortion caused by the placement of the null at 275°.

A resistivity tapered ground plane 10 is used to reduce back radiation lobes by attenuating the signals that are either diffracted or reflected from the edges of the ground plane. The surface resistivity of the sputtered film increases from approximately 0 at the center of the tapered-resistivity ground plane 10 to approximately 2000 ohms per square at the outer edge in an exponential manner. The use of the resistivity-tapered ground plane 10 also results in a smoothing out of ripples in the antenna pattern caused by interaction between the antenna signals and the signals diffracted from the edge of the ground plane.

The RHCP gain of the annular ring antenna 4, measured by using a standard gain horn antenna was 2.5 dBic. The gain can be increased by increasing the thickness 34 of the dielectric substrate layer 8 to 0.2" from its current thickness of 0.1" to improve radiation efficiency and bandwidth. As previously mentioned, the prototype antenna array 2 used a Rogers 6010 LM substrate material, however the gain can improved by using a lower dielectric constant substrate such as TMM6 (with a dielectric constant of 6). The size of the annular ring antenna 4 can also be reduced by designing the annular ring antenna 4 to resonate either at the $TM_{31}$ or $TM_{21}$ mode.

Figure 3B:
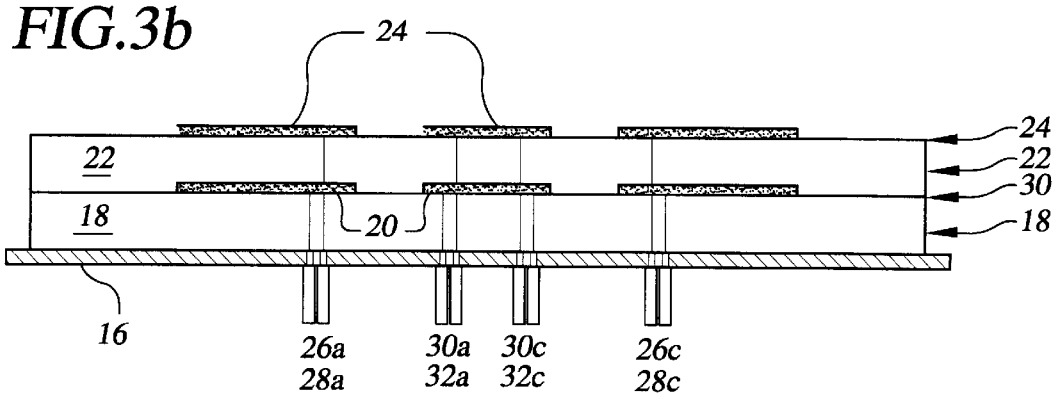
FIG. 3*b* is a schematic diagram illustrating a side view of a stacked four-element antenna array in accordance with the invention.

In another embodiment, the present invention is a dual frequency band (GPS $L_1$ and $L_2$) version of the multipath mitigating antenna array 2 comprised of stacked pairs of microstrip patch antenna elements as described above, and as illustrated in FIG. 3*b*, wherein each pair of antenna elements is tuned to a different GPS frequency band. In this embodiment, a first pair of microstrip patch elements 20 (annular ring and circular) operate in a first GPS frequency band, and a second pair of microstrip patch elements (annular ring and circular) operate in a second GPS frequency band. FIG. 3*b* illustrates the stacking concept. The first pair of microstrip elements 20 lie above a first dielectric layer 18 and a metallic or resistivity-tapered ground plane 16, and are designed to adaptively cancel out cross polarized LHCP multipath signals received by a first annular ring antenna in the first pair of elements 20. A second dielectric substrate layer 22 is stacked upon the first pair of elements 20. A second pair of microstrip patch antenna elements 24 are stacked upon the second dielectric substrate layer 22, and are designed to similarly adaptively cancel out cross polarized LHCP multipath signals received by a second annular ring antenna in the second pair of elements 24. The excitation scheme is similar to that of the two element antenna array 2, wherein each antenna element of each pair of elements is excited by four symmetrically positioned probes (26*a–d*, 28*a–d*, 30*a–d*, 32*a–d*) forcing each antenna to radiate RHCP lower order $TM_{11}$ mode radiation patterns, through appropriate amplitude and phase angles.

Simultaneous Satellite and Terrestrial Communications Array

Yet another application for antenna array 2 is in systems needing simultaneous satellite and terrestrial communications. The inner (circular) microstrip patch antenna 6 can be excited to generate a single lobe, circularly polarized antenna pattern directed towards the zenith at a desired SATCOM frequency. At the same time, the outer (annular ring) microstrip patch antenna 4, which is disposed around the inner (circular) microstrip patch antenna 6 and resonant in a higher order mode, can provide terrestrial communication capability at a desired frequency by radiating a vertically polarized, omni-directional "doughnut" pattern with a peak gain at the horizon and a null at the zenith. Tuning the outer (annular ring) antenna 4 and inner (circular) microstrip patch antenna 6 to separate frequencies will allow greater versatility in wireless communications. The inner and outer antennas of this array can also tuned to the same frequency band to allow antenna pattern coverage over the entire upper hemisphere that may be needed in certain types of SATCOM systems containing multiple satellites covering a wide range of elevation angles spanning the upper hemisphere.

Other embodiments of the invention, including those in which the outer microstrip patch antenna is designed to resonate in higher order modes other than the $TM_{41}$ of the inventors' prototype, will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A spatial null steering microstrip antenna array comprising:

an inner microstrip patch antenna for use as an auxiliary element in nulling interference;

an outer microstrip patch antenna disposed around the inner microstrip patch antenna, the outer microstrip patch antenna having a geometry symmetrical to the inner microstrip patch antenna and resonance in a higher-order mode;

a dielectric substrate layer below the inner microstrip patch antenna and outer microstrip patch antenna;

a conducting ground plane below the dielectric substrate layer extending beyond the outermost dimensions of the outer microstrip patch antenna;

a first set of four coaxial probes, each probe extending up through the conducting ground plane and the dielectric substrate layer and connected on one end to one of four points on the inner microstrip patch antenna symmetrically spaced at 90° intervals;

a second set of four coaxial probes, each probe extending up through the conducting ground plane and the dielectric substrate layer and connected on one end to one of four points on the outer microstrip patch antenna symmetrically spaced at 90° intervals;

wherein each of the first set and second set of probes are driven in equal amplitudes but at relative phase angles of 0°, 90°, 180°, and 270° respectively, thereby forcing the outer microstrip patch antenna and inner microstrip patch antenna to each generate a right hand circularly polarized lower order $TM_{11}$ mode far field radiation pattern and allowing co-modal phase tracking between the inner microstrip patch antenna and outer microstrip patch antennas; and means for shaping a combined radiation pattern of the inner microstrip patch antenna and outer microstrip patch antennas to null out received signals from interference sources at a pre-selected elevation angle.

2. A spatial null steering microstrip antenna array comprising:

a circular microstrip patch antenna for use as an auxiliary element in nulling interference;

an annular ring microstrip patch antenna disposed around the circular microstrip patch antenna, the annular ring microstrip patch antenna having a geometry symmetrical to the circular microstrip patch antenna and resonance in a higher-order $TM_{41}$ mode;

a dielectric substrate layer below the circular microstrip patch antenna and annular ring microstrip patch antenna;

a conducting ground plane below the dielectric substrate layer extending beyond the outer diameter of the annular ring microstrip patch antenna;

a first set of four coaxial probes, each probe extending up through the conducting ground plane and the dielectric substrate layer and connected on one end to one of four points on the circular microstrip patch antenna symmetrically spaced at 90° intervals;

a second set of four coaxial probes, each probe extending up through the conducting ground plane and the dielectric substrate layer and connected on one end to one of four points on the outer microstrip patch antenna symmetrically spaced at 90° intervals;

wherein each of the first set and second set of probes are driven in equal amplitudes but at relative phase angles of 0°, 90°, 180°, and 270° respectively, thereby forcing the outer microstrip patch antenna and circular microstrip patch antenna to each generate a right hand circularly polarized lower order $TM_{11}$ mode far field radiation pattern and allowing co-modal phase tracking between the circular microstrip patch antenna and outer microstrip patch antennas; and means for shaping a combined radiation pattern of the circular microstrip patch antenna and annular ring microstrip patch antennas to adaptively cancel received interference signals at a pre-selected elevation angle.

3. The spatial null steering microstrip antenna array of claims 1 or 2, wherein the conducting ground plane further comprises a resistivity tapered conducting ground plane for suppression of antenna back-lobes.

4. The spatial null steering microstrip antenna array of claims 1 or 2, wherein the conducting ground plane further comprises a film with a sputtered, tapered resistive film of Indium Tin Oxide, bonded to a thin plastic plate.

5. A GPS multipath suppression antenna array, comprising an annular ring antenna for receiving GPS signals resonant in a higher order $TM_{41}$ mode;

a circular mnicrostrip antenna concentrically positioned within the annular ring antenna for use as an auxiliary element in cancelling out cross polarized LHCP multipath signals received by the annular ring antenna;

a dielectric substrate layer sandwiched below the antennas and above a resistivity tapered ground plane; and a means for exciting both the circular microstrip antenna and the annular ring antenna to generate RHCP lower order $TM_{11}$ mode far field radiation patterns, allowing the annular ring radiation pattern to phase track the radiated signals from the circular microstrip antenna to allow cancellation of the cross polarized GPS multipath at a desired elevation angle.

6. A dual frequency GPS multipath suppression antenna array, comprising:

a first annular ring antenna for receiving GPS signals in a first frequency band resonant in a higher order $TM_{41}$ mode;

a first circular microstrip antenna concentrically positioned within the first annular ring antenna for use as an auxiliary element in cancelling out cross polarized LHCP multipath signals received by the first annular ring antenna;

a first dielectric substrate layer sandwiched beneath the first antennas and above a resistivity tapered ground plane;

a second dielectric substrate layer stacked on top of the first circular and first annular ring antennas, a second annular ring antenna for receiving GPS signals in a second frequency band resonant in a higher order $TM_{11}$ mode stacked on top of the second dielectric substrate layer and positioned coaxially above the first annular ring antenna;

a second circular microstrip antenna positioned within the second annular ring antenna and stacked on top of the second dielectric substrate layer and positioned coaxially above the first circular microstrip antenna;

means for exciting both the first circular microstrip antenna and the first annular ring antenna to generate RHCP lower order $TM_{11}$ mode far field radiation patterns, allowing the first annular ring radiation pattern to phase track the radiated signals from the first circular microstrip antenna to allow cancellation of the cross polarized GPS multipath at a desired elevation; and means for exciting both the second circular microstrip antenna and the second annular ring antenna to generate RHCP lower order $TM_{11}$ mode far field radiation patterns, allowing the second annular ring radiation pattern to phase track the radiated signals from the second circular microstrip antenna to allow cancellation of the cross polarized GPS multipath at a desired elevation angle.

7. An dual use satellite and terrestrial communications antenna array, comprising:

a circular microstrip patch antenna generating a single lobe, circularly polarized antenna pattern directed towards zenith for communicating with the satellite at a desired SATCOM frequency;

an annular ring microstrip patch antenna disposed around the circular microstrip patch antenna, the annular ring mnicrostrip patch antenna being resonant in a higher order $TM_{41}$ mode, but simultaneously generating a zero order (TEM type), doughnut shaped, modal pattern with peak gain at horizon and a null at zenith for communicating terrestrially at a desired frequency;

a dielectric substrate layer sandwiched beneath the circular microstrip patch antenna and annular ring microstrip patch antenna and above a conducting ground plane;

a plurality of coaxial probes, each probe extending through the conducting ground plane and dielectric substrate layer, for exciting the circular microstrip patch antenna or the annular ring microstrip patch antenna.

8. The antenna array of claim 7, wherein the conducting ground plane is metallic.

9. The antenna array of claim 7, wherein the conducting ground plane is a resistivity tapered conducting ground plane.

10. The antenna array of claim 7, wherein the circular microstrip patch antenna and annular ring microstrip patch antenna are each tuned to a separate frequency to allow simultaneous communications with both the SATCOM and terrestrial communications systems.

* * * * *